US006188377B1

(12) United States Patent
Campbell et al.

(10) Patent No.: US 6,188,377 B1
(45) Date of Patent: Feb. 13, 2001

(54) INTERNAL ROW SEQUENCER FOR REDUCING BANDWIDTH AND PEAK CURRENT REQUIREMENTS IN A DISPLAY DRIVER CIRCUIT

(75) Inventors: John Gray Campbell; Edwin Lyle Hudson, both of Los Altos, CA (US)

(73) Assignee: Aurora Systems, Inc., San Jose, CA (US)

( * ) Notice: Under 35 U.S.C. 154(b), the term of this patent shall be extended for 0 days.

(21) Appl. No.: 09/047,947

(22) Filed: Mar. 25, 1998

Related U.S. Application Data

(63) Continuation-in-part of application No. 08/970,443, filed on Nov. 14, 1997.

(51) Int. Cl.[7] ..... G09G 3/36
(52) U.S. Cl. ..... 345/98; 345/100
(58) Field of Search ..... 345/98, 100, 94, 345/87, 84, 204; 348/714–719

(56) References Cited

U.S. PATENT DOCUMENTS 4,123,751 * 10/1978 Gladstone et al. ..... 345/76
4,694,406 * 9/1987 Shibui et al. ..... 345/123
5,278,652 1/1994 Urbanus et al. ..... 358/160
5,339,116 8/1994 Urbanus et al. ..... 348/716
5,394,375 * 2/1995 Iwashita ..... 365/230.06
5,523,803 6/1996 Urbanus et al. ..... 348/771
5,724,061 * 3/1998 Kanbara ..... 345/100
5,852,428 * 12/1998 Ishikawa ..... 345/100
5,896,118 * 4/2000 Netsu ..... 345/98

* cited by examiner

*Primary Examiner*—Regina Liang
(74) *Attorney, Agent, or Firm*—Henneman & Saunders; Larry E. Henneman, Jr.

(57) ABSTRACT

A display driver circuit includes a word line sequencer for providing a series of row addresses, and a row decoder for decoding each of the row addresses and asserting write signals on corresponding ones of a plurality of output terminals. An optional data path sequencer provides a series of path addresses which are used by an optional data router to route data to particular sub-rows of a display. Additionally, an optional sub-row sequencer provides a series of sub-row addresses to an optional sub-row decoder, which decodes each of the sub-row addresses and asserts write signals on corresponding ones of a second plurality of output terminals. In various embodiments, the row sequencer, the sub-row sequencer, and/or the data path sequencer is/are responsive to data load instructions from a system, such that no Array Write commands are required to write data to a display.

31 Claims, 10 Drawing Sheets

| OP[1] | OP[0] | Functions |
|---|---|---|
| 0 | 0 | No OP |
| 0 | 1 | Data Write. Load D[31:0] into next position of the Write Hold Register |
| 1 | 0 | Array Write |
| 1 | 1 | Load Row Address into Row Decoder |

300

| OP[1] | OP[0] | Functions |
|---|---|---|
| 0 | 0 | No OP |
| 0 | 1 | Data Write. Load D[31:0] into next position of the Write Hold Register |
| 1 | 0 | Array Write (Optional: Load D[31:0] into next position of the Write Hold Register) |
| 1 | 1 | Load Row Address into Row Address Register. (Also re-synchronizes the Write Hold Register) |

600

INTERNAL ROW SEQUENCER FOR REDUCING BANDWIDTH AND PEAK CURRENT REQUIREMENTS IN A DISPLAY DRIVER CIRCUIT

CROSS REFERENCE TO RELATED APPLICATION

This application is a continuation-in-part of our prior application Ser. No. 08/970,443 filed Nov. 14, 1997, entitled "Internal Row Sequencer For Reducing Bandwidth And Peak Current Requirements In A Display Driver Circuit," which is incorporated herein by reference in its entirety.

BACKGROUND OF THE INVENTION

1. Field of the Invention

This invention relates generally to circuits for driving electronic displays, and more particularly to a system and method for using an internal sequencer to sequentially drive the word lines of a display.

2. Description of the Background Art

FIG. 1 shows a prior art display driver circuit 100, for driving a display 102, which includes an array of pixel cells arranged in 768 rows and 1024 columns. Display driver circuit 100 includes row decoder 104, write hold register 106, pointer 108, instruction decoder 110, invert logic 112, timing generator 114, and input buffers 116, 118, and 120. Driver circuit 100 receives clock signals via SCLK terminal 122, invert signals via invert (INV) terminal 124, data and addresses via 32-bit system data bus 126, and operating instructions via 2-bit op-code bus 128, all from a system (e.g., a computer) not shown. Timing generator 114 generates timing signals, by methods well known to those skilled in the art, and provides these timing signals to the components of driver circuit 100 via clock signal lines (not shown), to coordinate the operation of each of the components.

Invert logic 112 receives the invert signals from the system via INV terminal 124 and buffer 116, and receives the data and addresses from the system via system data bus 126 and buffer 118. Responsive to a first invert signal ($\overline{\text{INV}}$), invert logic 112 asserts the received data and addresses on a 32-bit internal data bus 130. Responsive to a second invert signal (INV), invert logic 112 asserts the complement of the received data on internal data bus 130. Internal data bus 130 provides the asserted data to write hold register 106, and provides the asserted row addresses (via 10 of its 32 lines) to row decoder 104.

Instruction decoder 110 receives op-code instructions from the system, via op-code bus 128 and buffer 120, and, responsive to the received instructions, provides control signals, via an internal control bus 132, to row decoder 104, write hold register 106, and pointer 108. Responsive to the system asserting data on system data bus 126 and a first instruction (i.e., Data Write) on op-code bus 128, instruction decoder 110 asserts control signals on control bus 132, causing write hold register 106 to load the asserted data via internal data bus 130 into a first portion of write hold register 106. Because internal data bus 130 is only 32 bits wide, 32 data write commands are necessary to load an entire line (1024 bits) of data into write hold register 106. Pointer 108 provides an address, via a set of lines 134, which indicates the portion of write hold register 106 to which the data is to be written. As each successive Data Write command is executed, pointer 108 increments the address asserted on lines 134 to indicate the next 32-bit portion of write hold register 106.

Responsive to the system asserting a row address on system data bus 126 and a second instruction (i.e., load row address) on op-code bus 128, instruction decoder 110 asserts control signals on control bus 132 causing row decoder 104 to store the asserted row address. Then, responsive to the system asserting a third instruction (i.e., Array Write) on op-code bus 128, instruction decoder 110 asserts control signals on control bus 132, causing write hold register 106 to assert the 1024 bits of stored data on a set of 1024 data output terminals 136, and causing row decoder 104 to decode the stored row address and assert a write signal on one of a set of 768 word-lines 138 corresponding to the decoded row address. The write signal on the corresponding word-line causes the data being asserted on data output terminals 136 to be latched into a corresponding row of pixel cells (not shown in FIG. 1) of display 102.

Those skilled in the art will recognize that write hold register 106, pointer 108, invert logic 112, and buffers 116 and 118 function together as data processing means 150 for receiving data from the system, accumulating and formatting the data, and providing the data to display 102. Row decoder 104 functions as row selecting means 160 for selecting a row of display 102 to which the data provided by data processing means 150 is to be written. Instruction decoder 110 functions as instruction means for receiving op-code instructions from the system, and controlling and coordinating data processing means 150 and row selecting means 160 responsive to the received op-code instructions.

FIG. 2 shows an exemplary pixel cell 200(*r*,*c*) of display 100, where (r) and (c) indicate the row and column of the pixel cell, respectively. Pixel cell 200 includes a latch 202, a pixel electrode 204, and switching transistors 206 and 208. Latch 202 is a static random access memory (SRAM) latch. One input of latch 202 is coupled, via transistor 206, to a Bit+ data line 210(*c*), and the other input of latch 202 is coupled, via transistor 208 to a Bit− data line 212(*c*). The gate terminals of transistors 206 and 208 are coupled to word line 138(*r*). An output terminal 214 of latch 202 is coupled to pixel electrode 204. A write signal on word line 138(*r*) places transistors 206 and 208 into a conducting state, causing the complementary data asserted on data lines 210(*c*) and 212(*c*) to be latched, such that the output terminal 214 of latch 202, and coupled pixel electrode 204, are at the same logic level as data line 210(*c*).

FIG. 3 shows an instruction table 300, which sets forth the op-code instructions used to drive display driver circuit 100. Each operation is explained with reference to FIG. 1. Op-code (00) corresponds to a No Op instruction, which is ignored by driver circuit 100. Op-code (01) is a Data Write command, which causes data being asserted on system data bus 126 to be loaded into write hold register 106. Op-code (11) is a Load Row Address command, which causes a row address being asserted on system data bus 126 to be loaded into row decoder 104. Op-code (10) is an Array Write command, which causes one line (1024 bits) of the data stored in write hold register 136 to be transferred to the latches of the row of pixel cells corresponding to the row address stored in row decoder 104.

FIG. 4 is a timing diagram showing how the above described op-codes are used to control driver circuit 100. During a first SCLK cycle, the system asserts a Data Write command (01) on op-code bus 128, causing a first 32-bit block (block 0) of data being asserted on system data bus 126 (D[31:0]) to be loaded into write hold register 106. During the next 31 SCLK cycles, the system asserts Data Write commands (01) causing 31 more 32-bit blocks to be loaded into write hold register 106, thus assembling a complete line of (1024) bits in write hold register 106. Next, the system asserts a row address (RA) on 10-bits of system data bus 126 (e.g., D)[9:0]) and a Load Row Address command (11) on op-code bus 128, loading the asserted address into row decoder 104. Finally, the system asserts a Array Write command (10) on op-code bus 128, causing the complete line of data in write hold register 106 to be loaded into a row of pixel cells of display 102 identified by the address in row decoder 104. This sequence is repeated to transfer each subsequent row of data from the system to display 102.

Prior art display driver 100 suffers from at least two disadvantages. First, because an entire row (1024 bits) of data is written to display 102 at once, driver circuit 100 and display 102 generate relatively large peak currents. Second, because a row address must be loaded prior to writing each line of data to display 102, driver circuit 100 has a relatively high system interface bandwidth requirement. Further, the peak current and the system bandwidth requirements are interrelated, in that writing data to smaller blocks of pixel cells at one time to reduce the peak current requirement increases the bandwidth requirement, because of the additional row addresses that must be loaded. What is needed is a display driver circuit with a reduced peak current requirement and a reduced system interface bandwidth requirement.

SUMMARY

A novel display driver circuit is described. One embodiment of the display driver circuit includes a row sequencer, for providing a series of row addresses at an output. The driver circuit further includes a row decoder having an input, coupled to the output of the row sequencer, and a plurality of output terminals. The row decoder decodes each of the addresses provided by the row sequencer and asserts a data write signal on a corresponding one of the output terminals. Optionally, the display driver circuit includes a row address register coupled to provide an initial row address to the row sequencer. The row address register further includes an input terminal for receiving another initial row address. The row sequencer includes a control input terminal for receiving control signals. Responsive to receipt of a first control signal, the row sequencer outputs a next address of the series of row addresses. Responsive to receipt of a second control signal, the row sequencer receives the other initial row address from the row address register, and outputs a new series of row addresses starting from the other initial row address. Optionally, the row sequencer outputs a series of sub-row addresses, and the row decoder is a sub-row decoder.

A particular embodiment of the display driver circuit further includes a data path sequencer and a data router. The data path sequencer provides a series of path addresses at an output. The data router has an input terminal set coupled to the output of the data path sequencer for receiving the data path addresses, a data input terminal set, a first data output terminal set, and a second data output terminal set. The data router routes data by selectively coupling the data input terminal set with either the first or the second data output terminal set, depending on the path address received from the data path sequencer.

Another particular embodiment of the display driver circuit further includes a sub-row sequencer and a sub-row decoder. The sub-row sequencer provides a series of sub-row addresses at an output. The sub-row decoder has an input coupled to the output of the sub-row sequencer, and a plurality of output terminals. The sub-row decoder receives the sub-row addresses from the sub-row sequencer, decodes the addresses, and asserts a write signal on a corresponding one of the plurality of output terminals. This particular embodiment optionally includes a data path sequencer and a data path router.

In other alternate embodiments, the row sequencer, the sub-row sequencer, and/or the data path sequencer operate responsive to Data Load commands, beneficially eliminating the need for Array Write commands. In each case, subsequent addresses are generated by the respective sequencers in response to receiving a predetermined number of Data Load commands. In yet another embodiment, the row sequencer, the sub-row sequencer, and/or the data path sequencer operate responsive to register portion addresses, generated by a pointer responsive to the receipt of Data Load commands, also eliminating the need for Array Write commands.

A method for driving a display is also disclosed. The method includes the steps of receiving a first initial row address from a system, generating a series of row addresses based on the first initial row address, decoding each of the row addresses of the series of row addresses, and asserting a series of write signals on a first group of a plurality of output terminals, each output terminal of the first group corresponding to an associated row address. Optionally, the method further includes the steps of receiving another initial row address and generating another series of row addresses based on the other initial row address.

A particular method further includes the steps of generating a series of sub-row addresses, decoding each of the sub-row addresses, and asserting a write signal on a second group of the plurality of output terminals, each output terminal of the second group corresponding to a particular decoded sub-row address. Another particular method further includes the steps of generating a series of path addresses and routing data to sub-rows corresponding to the path addresses. Optionally, this particular method also includes the steps of generating a series of sub-row addresses, decoding each of the sub-row addresses, and asserting a write signal on the second group of output terminals.

An alternate method includes the steps of receiving a first initial row address from a system, generating a series of sub-row addresses based on the first initial row address, decoding each of the sub-row addresses of the series, and asserting a series of data load signals on a plurality of output terminals, each output terminal corresponding to an associated sub-row address. A particular method further includes the steps of receiving another initial row address, and generating another series of sub-row addresses based on the other initial row address.

In each of the above described methods, the step of generating a series of row addresses optionally includes the steps of outputting the initial row address responsive to a first Array Write command generating a second row address based on the initial row address, and outputting the second row address responsive to a second Array Write command.

An alternate method, which eliminates the need for Array Write commands, includes the steps of asserting a first write signal on a first word line of the display; receiving data load instructions from the system; receiving a first predetermined quantity of data from the system responsive to each data load instruction; accumulating the data; asserting the accumulated data on data input lines of the display each time a second predetermined quantity of data is accumulated; determining from the data load instructions when a third predetermined quantity of data has been subsequently asserted on the data input lines; and asserting a subsequent write signal on a subsequent word line associated with a subsequent portion of the display, each time the third predetermined quantity of data has been subsequently asserted on the data input lines.

In a particular method, the step of asserting a subsequent write signal on a subsequent word line associated with a subsequent portion of the display, each time the third predetermined quantity of data has been subsequently asserted on the data input lines includes the steps of generating a series of row addresses, each row address being generated responsive to receipt of a first predetermined number of data load instructions; decoding each row address; and asserting a write signal on one of the display word lines corresponding to each decoded row address.

BRIEF DESCRIPTION OF THE DRAWINGS

The present invention is described with reference to the following drawings, wherein like reference numbers denote substantially similar elements.

DETAILED DESCRIPTION

This patent application is related to the following co-pending patent applications, filed on Nov. 14, 1997 and assigned to a common assignee, each of which is incorporated herein by reference in its entirety:

De-Centered Lens Group For Use In An Off-Axis Projector, Ser. No. 08/970,887 Matthew F. Bone and Donald Griffin Koch, now issued as U.S. Pat. No. 6,076,931

System And Method For Reducing Peak Current And Bandwidth Requirements In A Display Drivel Circuit, Ser. No. 08/970,665 Raymond Pinkham, now issued as W. Spencer Worley, III. , Edwin Lyle Hudson, and John Gray Campbell;

System And Method For Using Forced State To Improve Gray Scale Performance Of A Display, Ser. No. 08/970,878 W. Spencer Worley, III and Raymond Pinkham, U.S. Pat. No. 6,072,452 and System And Method For Data Planarization, Ser. No. 08/970,307 William Weatherford, W. Spencer Worley, III, and Wing Chow.

This patent application is also related to co-pending patent application Ser. No. 08/901,059, entitled Replacing Defective Circuit Elements By Column And Row Shifting In A Flat Panel Display, by Raymond Pinkham, filed Jul. 25, 1997, assigned to a common assignee, and is incorporated herein by reference in its entirety.

The present invention overcomes the problems associated with the prior art, by implementing an internal row sequencer, to reduce both the peak current and the system interface bandwidth requirement. In the following description, numerous specific details are set forth (e.g., op-code instructions, data and address bus bit-widths, and the number and organization of pixels within a display) in order to provide a thorough understanding of the invention. Those skilled in the art will recognize, however, that the invention may be practiced apart from these specific details. In other instances, details of well known display driving techniques (e.g. pulse-width modulation) and circuitry have been omitted, so as not to unnecessarily obscure the present invention.

Figure 5:
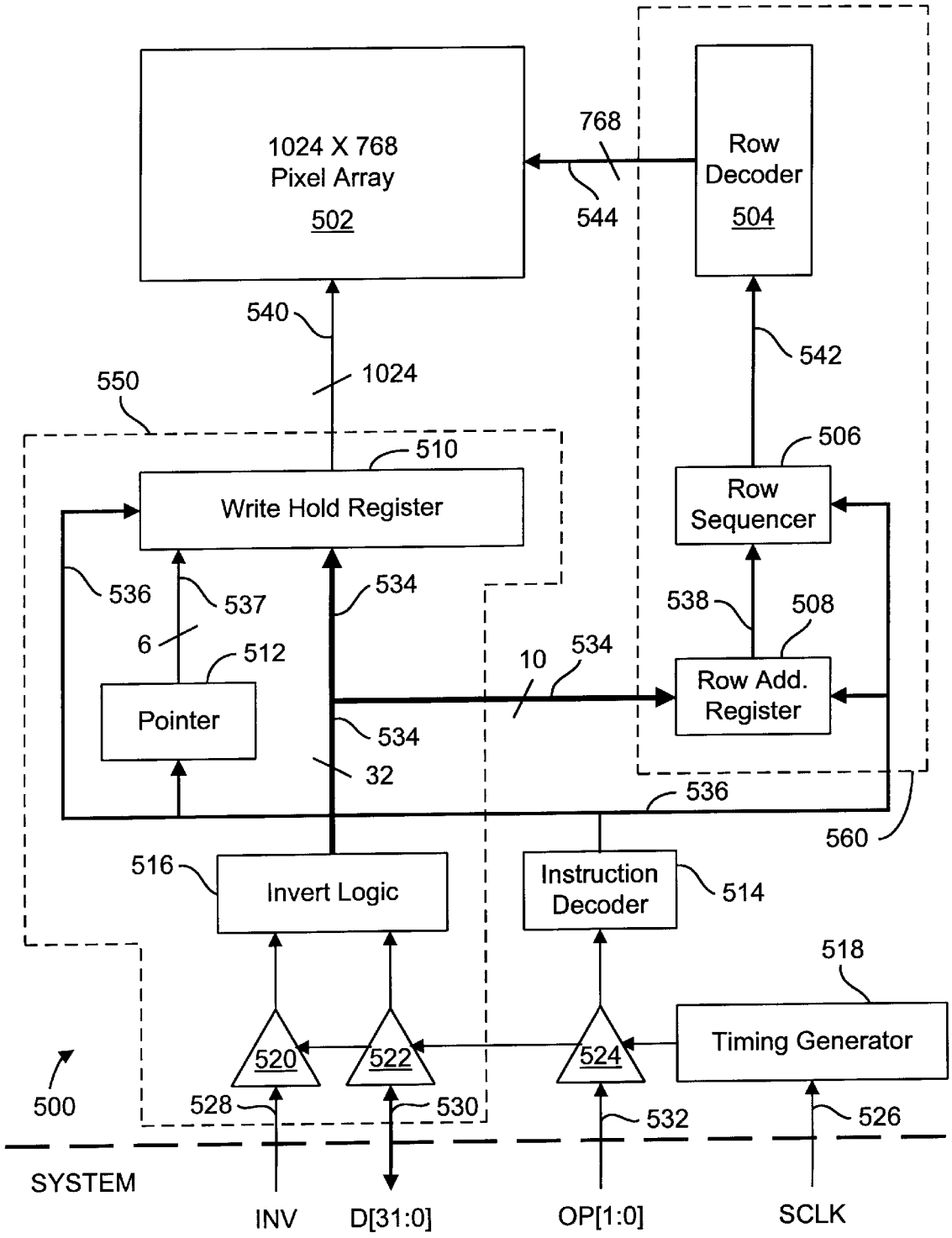
FIG. 5 is a block diagram of one embodiment of a display driver circuit, in accordance with the present invention.

FIG. 5 shows a display driver circuit 500, for driving a display 502 which includes an array of pixel cells arranged in 768 rows and 1024 columns. Display driver circuit 500 includes row decoder 504, row sequencer 506, row address register 508, write hold register 510, pointer 512, instruction decoder 514, invert logic 516, timing generator 518, and input buffers 520, 522, and 524. Driver circuit 500 receives clock signals via an SCLK terminal 526, invert signals via an invert (INV) terminal 528, data and addresses via a 32-bit system data bus 530 and operating instructions via a 2-bit op-code bus 532, all from a system (e.g., a computer, video signal source, etc.) not shown. Timing generator 518 generates timing signals, by methods well known to those skilled in the art, and provides these timing signals to the various components of driver circuit 500, via clock signal lines (not shown), to coordinate the operation of each of the components.

Invert logic 516 receives the invert signals from the system, via INV terminal 528 and buffer 520, and receives the data and addresses from the system, via system data bus 530 and buffer 522. Responsive to a first invert signal ($\overline{\text{INV}}$), invert logic 516 asserts the received data and addresses on a 32-bit internal data bus 534. Responsive to a second invert signal (INV), invert logic 516 asserts the complement of the received data on internal data bus 534. Internal data bus 534 provides the asserted data to write hold register 510, and provides the asserted addresses, via 10 of the 32 lines, to row address register 508.

Instruction decoder 514 receives op-code instructions from the system, via op-code bus 532 and buffer 524, and, responsive to the received instructions, provides control signals, via an internal control bus 536, to row sequencer 506, row address register 508, write hold register 510, and pointer 512.

Those skilled in the art will recognize that write hold register 510, pointer 512, invert logic 516, and buffers 520 and 522 function together as data processing means 550 for receiving data from the system, accumulating and formatting the data, and providing the data to display 102. Row decoder 504, row sequencer 506, and row address register 508 function together as row selecting means 560 for selecting a row of display 502 to which the data provided by data processing means 550 is to be written. Instruction decoder 514 functions as instruction means for receiving op-code instructions from the system, and controlling and coordinating data processing means 550 and row selecting means 560 responsive to the received op-code instructions.

Figures 6, 7:
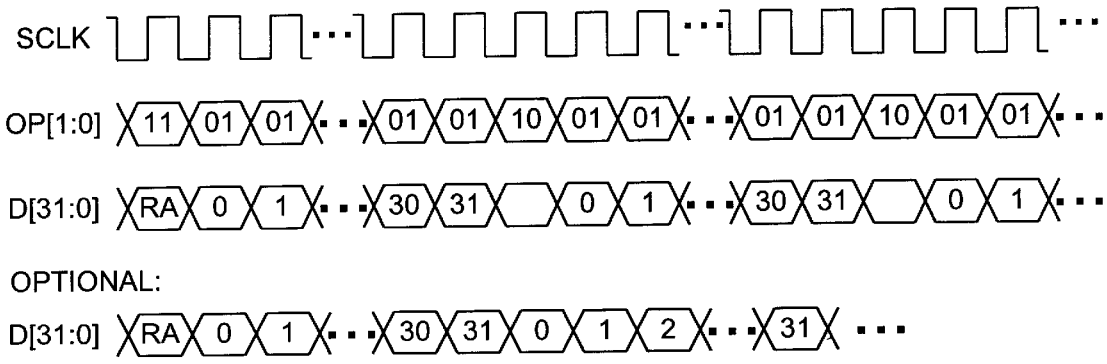
FIG. 6 is an operation code table for use with the display driver circuit of FIG. 5.
FIG. 7 is a timing diagram showing the control of the display driver circuit of FIG. 5.

FIG. 6 shows a table 600 which sets forth op-code instructions for use with display driver circuit 500. Each operation is explained with reference to FIG. 5. Op-code (00) corresponds to a No Op instruction to which instruction decoder 514 does not respond. Responsive to the system asserting data on system data bus 530 and a Data Write command (01) on op-code bus 532, instruction decoder 514 asserts control signals on control bus 536, causing write hold register 510 to load the asserted data, via internal data bus 534, into a first portion of write hold register 510. Because internal data bus 534 is only 32 bits wide, 32 Data Write commands (01) arc necessary to load an entire line (1024 bits) of data into write hold register 510. Pointer 512 provides an address, via a set of lines 537, to write hold register 510, the address indicating a portion of write hold register 510 to which the data is to be written. As each successive Data Write command (01) is executed, pointer 512 increments the address asserted on lines 537 to indicate the next 32-bit portion of write hold register 510.

Responsive to the system asserting an initial row address on system data bus 530 and a Load Row Address command (11) on op-code bus 532, instruction decoder 514 asserts control signals on control bits 536 causing row address register 508 to store the initial row address, and provide the initial row address, via a set of address lines 538, to row sequencer 506. Then, responsive to the system asserting an Array Write command (10) on op-code bus 532, instruction decoder 514 asserts control signals on control bus 536, causing write hold register 510 to assert the 1024 bits of stored data on a set of 1024 data output terminals 540 (coupled to data input terminals of display 502), and causing row sequencer 506 to assert the initial row address on a second set of address lines 542. Responsive to the initial row address being asserted on address line 542, row decoder 504 decodes the initial row address, and asserts a write signal on one of a set of 768 word lines 544 corresponding to the decoded initial row address. The write signal being asserted on the corresponding word-line causes the data being asserted on data output terminals 540 to be latched into a corresponding row of pixel cells of display 502.

Responsive to subsequent Array Write commands, row sequencer 506 generates a series of row addresses based on the initial row address, and asserts the series of row addresses on address lines 542. Responsive to the series of row addresses being asserted on address lines 542, row decoder 504 decodes each of the row addresses and asserts write signals on corresponding ones of word lines 544.

In alternate embodiments, row sequencer 506 may be configured to provide any desirable series of select line addresses. For example, the series may continually repeat itself, or may proceed only through a predetermined number of addresses and then stop. Additionally, the series may increment or decrement by some set value (e.g., 1, 2, or 3), or follow some other predetermined sequence.

In an alternate embodiment, the Array Write command also functions as a Data Write command. Because system data bus 530 is unused during an Array Write command, system data bus 530 can be used to load the next 32-bits of data in response to an Array Write command. This advantageously reduces the number of Data Write commands necessary to load an entire row of data in write hold register 510. In particular, in the alternate embodiment, one Array Write command and 31 Data Write commands are required, as opposed to 32 Data Write commands.

FIG. 7 is a timing diagram showing how the system loads data into driver circuit 500 and writes the loaded data to display 502. During the first SCLK cycle, the system asserts a Load Row Address command (11), causing row address register 508 to load a row address (RA) being asserted on system data bus 530. During the next 32 SCLK cycles, the system asserts Data Write commands (01) on op-code bus 5302 and d at a on system data bus 530, causing 32 (0–31) quad-bytes of data to be loaded into write hold register 510, each quad-byte of data consisting of 32 bits. Thus the 32 quad-bytes form a complete line of data (1024 bits) in write hold register 510. During the next clock cycle, the system asserts an Array Write command (10) on op-code bus 532, causing the loaded data to be written to display 502 During the next 32 clock cycles, a second line of data is loaded into write hold register 510, and then written to display 502 with a single Array Write command (10).

Note that the system did not need to load a second row address to write the second line of data to display 502. This is because row sequencer 506 generates the subsequent row addresses responsive to subsequent array write commands. Therefore, once the initial row address is loaded no further row addresses need to be loaded, unless the incoming data is out of sequence. The internal generation of row addresses advantageously reduces the system interface bandwidth requirement (i.e., saves load Row Address cycles).

Figure 8:
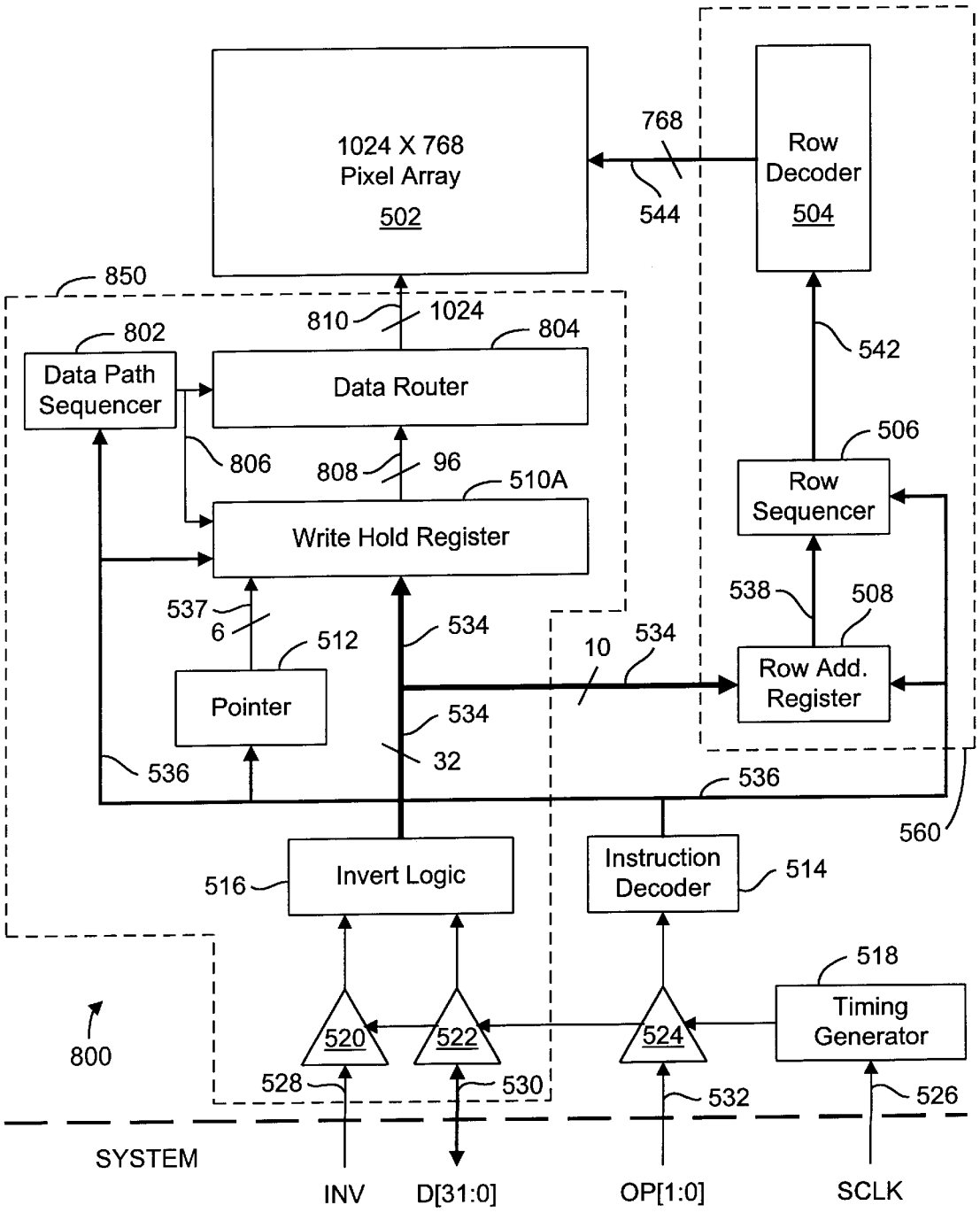
FIG. 8 is a block diagram of a second embodiment of a display driver circuit, in accordance with the present invention.

FIG 8 is a block diagram of an alternate display driver circuit 800, in accordance with the present invention. Driver circuit 800 is similar to driver circuit 500, except that write hold register 510 is replaced with a write hold register 510A, and a data path sequencer 802 and a data router 804 are added. Data path sequencer 802 generates a series of data path addresses and provides the addresses, via a set of address lines 806, to write hold register 510A and data router 804. Write hold register 510A outputs data, on a first set of data transfer lines 808, 96 bits at a time, as opposed to an entire line (1024 bits) at a time. Data router 804 receives the data asserted on data transfer lines 808, and directs the data to an appropriate sub row of display 502, by asserting the data on a corresponding subset of a second set of 1024 data transfer lines 810 (coupled to data input lines of display 502).

Data path sequencer 802 coordinates the actions of write hold register 510A and data router 804 as follows. Responsive to the system asserting an Array Write command (10) on op-code bus 532, instruction decoder 514 asserts control signals on control bus 536 causing data path sequencer 802 to assert a first path address on address lines 806. Responsive to the first path address being asserted on address lines 806, write hold register 510A asserts a first portion (96 bits) of a row of data on data transfer lines 808. Also responsive to the first row address being asserted on address lines 806, data router 804 selectively couples address lines 806 with a first sub-set of data transfer lines 810, directing the data to a first sub-row of display 502. Those skilled in the art will recognize that data router 804 is functioning as a multiplexer.

In a particular embodiment, write hold register 510A and data router 804 are integrated in a single unit. In this embodiment, each storage cell of the integrated write hold register is coupled to one of data transfer lines 810. The data routing is performed at the control level, with the integrated write hold register selectively asserting data on sequential sub-sets of data transfer lines 810, responsive to data path addresses provided by data path sequencer 802.

Recall that an Array Write command (10) also causes a write signal to be asserted on a selected one of word lines 544. Thus, the data directed by router 804 is written only to a first sub-row of the selected row. Further, those skilled in the art will understand that the write signal will not disturb the data in the remaining sub-rows of the selected row, because SRAM latches typically retain their data, notwithstanding the assertion of a write signal, as long as their data lines are not being driven (i.e., data being directed to the latch by data router 804).

Subsequent data path addresses generated by data path sequencer 802 cause write hold register 510A to output subsequent portions of the row of data on data transfer lines 808, which are directed by data router 804 to subsequent sub-rows of display 502. In particular, responsive to a single Array Write command, data path sequencer outputs a series of data path addresses including one address for each sub row of display 502, such that an entire row of data is written to the selected row of display 502.

Those skilled in the art will recognize that write hold register 510A, pointer 512, data path sequencer 802, data router 804, invert logic 516, and buffers 520 and 522 function together as data processing means 850 for receiving data from the system, accumulating and formatting the data, and providing the data to display 102. Instruction decoder 514 functions as instruction means for receiving op-code instructions from the system, and controlling and coordinating data processing means 850 and row selecting means 560 responsive to the received op-code instructions.

Writing data to display 502 a fraction of a row at a time substantially reduces the peak current requirements of driver circuit 800 and display 502. Those skilled in the art will recognize that the advantage of the invention is achieved, regardless of the number of sub-rows employed. Obviously, the greater the number of sub-rows, the greater the reduction in the peak current requirement. In the limiting case, the number of sub-rows is equal to the number of pixels in each row, so that each pixel constitutes a sub-row, and is written to individually.

Writing data to display 502 a fraction of a row at a time also allows display driver circuit 800 to drive displays having a relatively long write recovery time (time required for the data lines to stabilize before subsequent writes can be performed), advantageously eliminating the need for data-line recovery circuits in display 502. For example, if data is written to a display one row at a time, the display driver circuit must wait the entire write recovery time before data is written to the next row, so as not to interfere with the latching of the data into the previous row. In contrast, because display driver circuit 800 writes data to display 502 in sub-rows (i.e., 96 bits at a time), the write recovery time of display 502 can be 11 times longer. This is because after a first sub-row is written to, 10 other sub-row writes (the remainder of the row) occur before the first sub-row of the next row is written to. As a result, data can be clocked into display driver circuit 800 at a rate that is far greater (i.e., 11 times greater) than the write recovery time of display 502 would otherwise permit.

In this particular embodiment, each sub-row includes 96 bits. As a result, address lines 806 include at least 4 bits, to address 11 sub-rows. Note that 11 sub-rows of 96 bits is equal to a total of 1056 bits, not 1024. This does not present a problem, however, because the extra bits are simply unused during the data transfer to the last sub-row. As indicated above, any number of sub-rows may be employed (e.g., 2 sub-rows of 512 bits, 4 sub rows of 256 bits, 8 sub-rows of 128 bits, etc.).

In an alternate embodiment, no Array Write commands are necessary in order for data path sequencer 802 to generate a series of data path addresses. Instead, data path sequencer 802 includes a counter which counts the number of data load control signals asserted on control bus 536 by instruction decoder 514, and increments the data path address on address lines 806 accordingly. For example, after the third quad-byte of data is loaded into write hold register 510A, data path sequencer 802 asserts the first data path address on address lines 806, causing write hold register 510A to assert the first three quad bytes of data on data transfer lines 808. Subsequently, data path sequencer 802 increments the data path address following the loading of every third quad-byte of data, causing write hold register 510A to assert each group of 3 quad-bytes on data transfer lines 808. When the count indicates that the last data of the line has been loaded into write hold register 510A, data path sequencer 802 increments the data path address, causing write hold register to assert the last data on data transfer lines 808, and then data path sequencer 802 resets. In order to eliminate the need for Array Write commands, row sequencer 506 must also count the number of data load control signals asserted on control bus 536 by instruction decoder 514, and increment the row address after the last data of a row has been transferred out of write hold register 510A. Eliminating the need for Array Write commands beneficially reduces the interface bandwidth requirement between display driver circuit 800 and the system.

In a particular alternate embodiment, where all groups of data clocked out of write hold register 510A are the same size, data path sequencer 802 need not have reset capabilities, and may be a simple divide-by-n counter, which rolls over to the original address when the last data is loaded. For example, if data is clocked out of write hold register 510 128 bits at a time, then all the groups of data are the same size (128×8=1024). Data path sequencer 802 can, therefore, simply be a 2-bit divide-by-4 counter followed by a 3-bit a divide-by-8 counter. After the last data is loaded, the three bit address rolls over from (111) to (000). Optionally, data path sequencer 802 may be combined with pointer 512.

Figure 9:
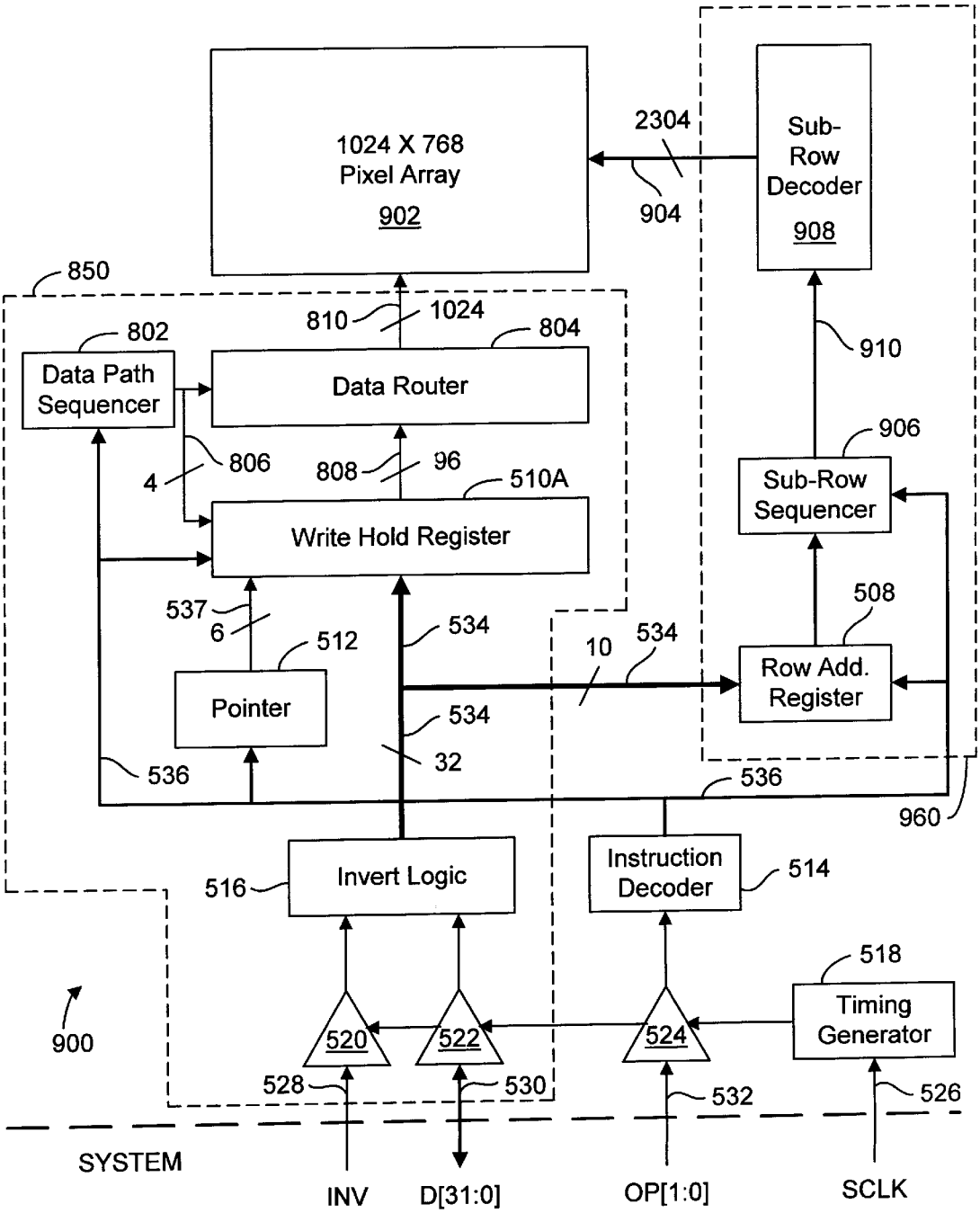
FIG. 9 is a block diagram of a third embodiment of a display driver circuit, in accordance with the present invention.

FIG. 9 shows another alternate display driver circuit 900, in accordance with the present invention. Display driver circuit 900 is designed to drive a display 902, wherein each row is divided into a number of sub-rows, each serviced by a separate one of a set of 2304 word sub-lines 904. As indicated by the number of word sub-lines, each of the 768 rows of pixels in display 902 is divided into 3 sub-rows. Those skilled in the art will recognize that some other number of sub-rows may be employed, as long as each is served by a separate word sub-line.

Display driver circuit 900 is similar to display driver circuit 800, except that row sequencer 506 is replaced by sub-row sequencer 906, and row decoder 504 is replaced by sub-row decoder 908. Responsive to an Array Write command (10), sub-row sequencer 906 receives an initial row address from row address register 508, converts the initial row address to an initial sub-row address (e.g., the first sub-row in the indicated row), and provides the sub-row address, via a set of address lines 910, to sub-row decoder 908. Sub-row decoder 908 decodes the initial sub-row address and asserts a write signal on a corresponding one of word sub-lines 904. Next, sub-row sequencer 906 increments the address on address lines 910, sequentially asserting the address of each sub-row of the row corresponding to the initial row address. Sub-row decoder 908 decodes each of the sub-row addresses and asserts write signals on the corresponding ones of word sub-lines 904. Thus, sub-row decoder 908, sub-row sequencer 906, and row address register 508 function together as sub-row selecting means 960 for selecting a sub-row of display 902 to which the data provided by data processing means 850 is to be written. Further, those skilled in the art will understand that data path sequencer 802, data router 804, and write hold register 510A may be replaced with write hold register 510 in display driver circuit 900, because a write signal is provided to only one sub-row at a time.

Figure 1:
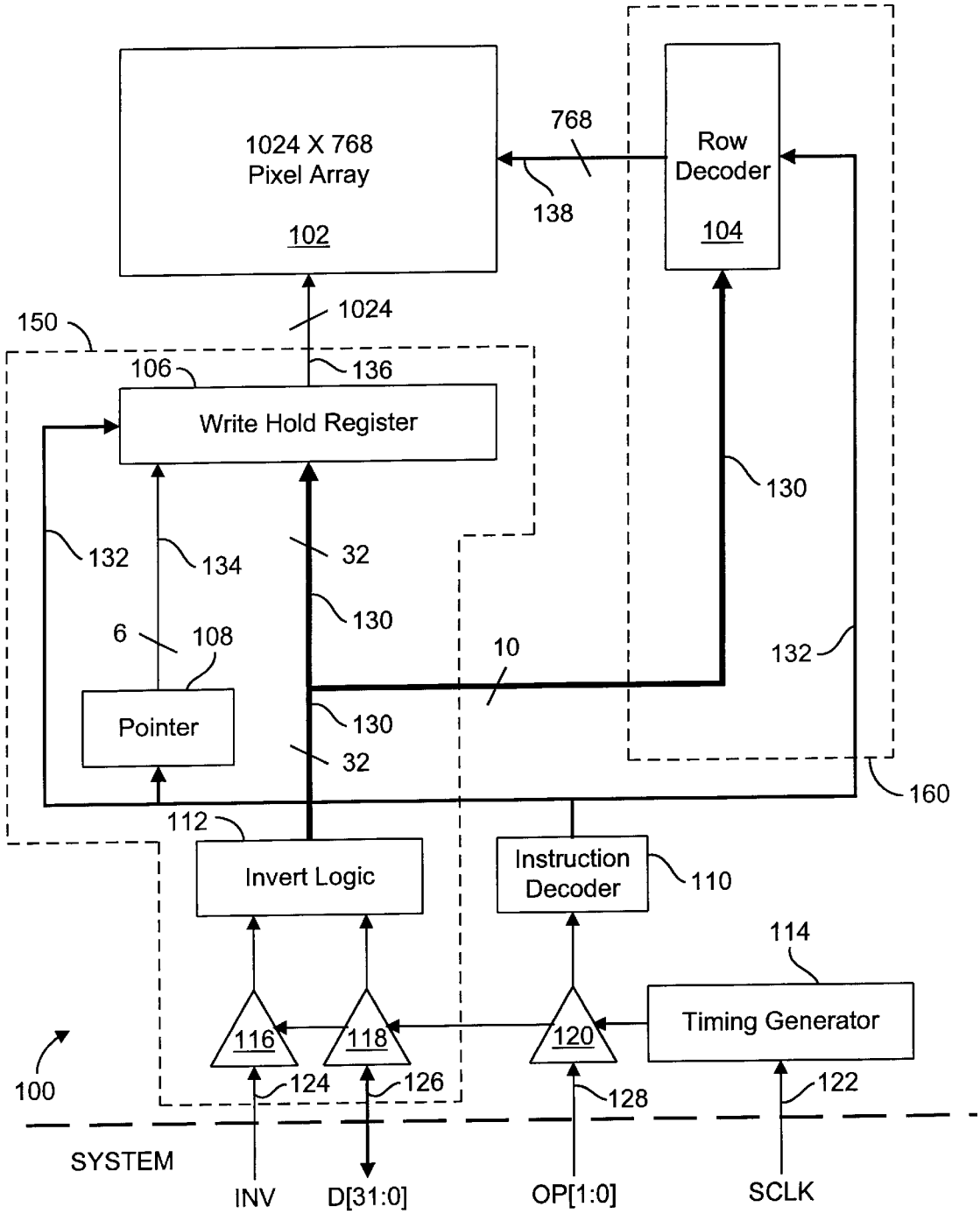
FIG. 1 Prior Art
FIG. 1 is a block diagram of a prior art display driver circuit.
Figure 2:
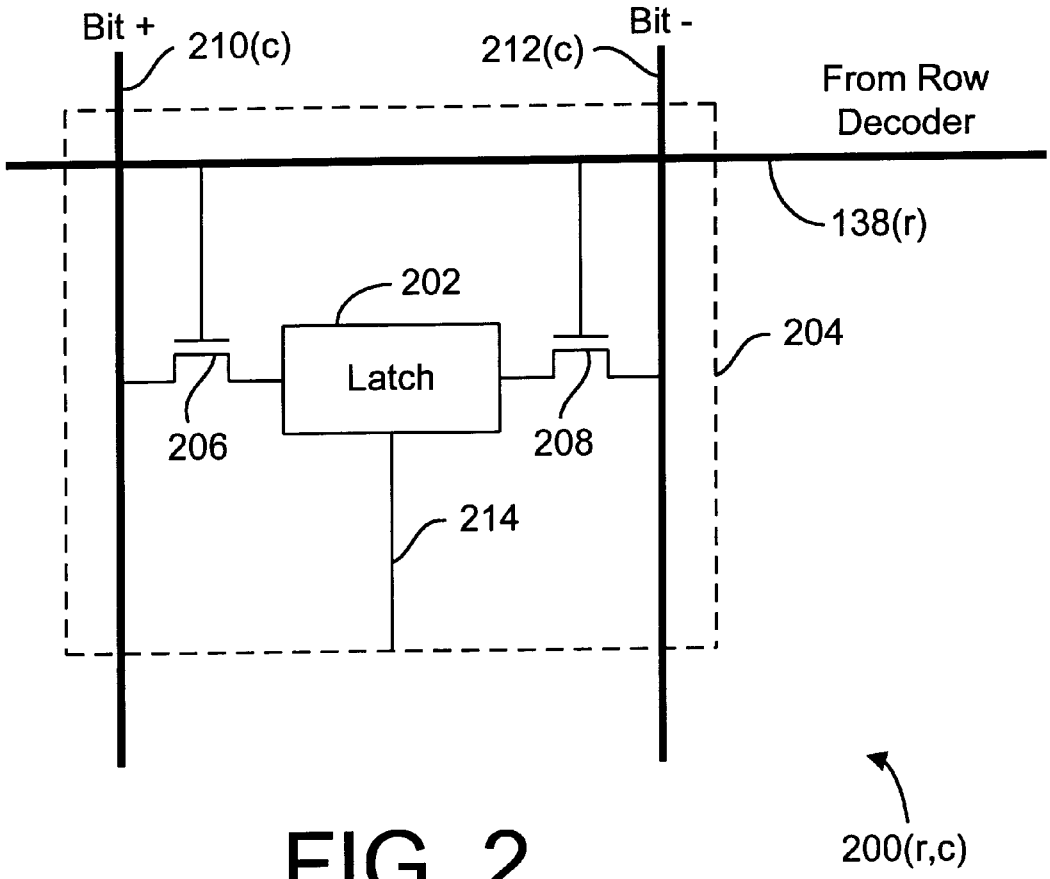
FIG. 2 Prior Art
FIG. 2 is a block diagram of an exemplary pixel cell of a display shown in FIG. 1.
Figures 3, 4:
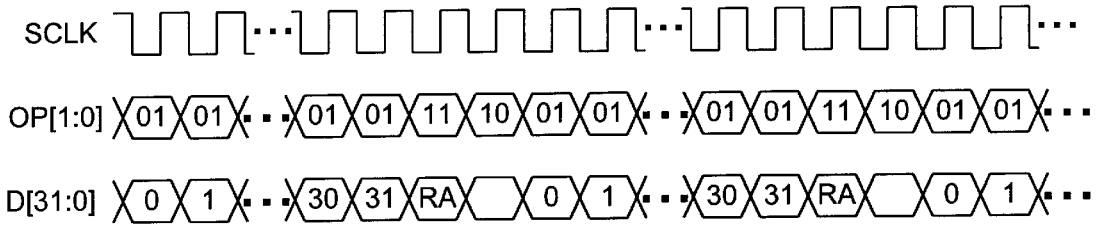
FIG. 3 Prior Art
FIG. 4 Prior Art
FIG. 3 is an operation code table for use with the display driver circuit of FIG. 1.
FIG. 4 is a timing diagram showing the control of the display driver circuit of FIG. 1.
Figure 10:
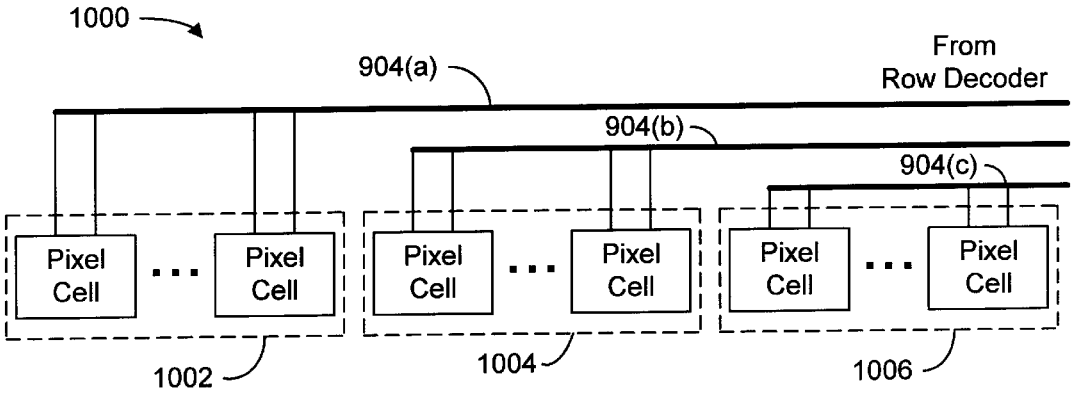
FIG. 10 is a block diagram of a row of pixel cells of the display driver circuit of FIG. 9.

FIG. 10 shows an exemplary row 1000 of pixel cells of display 902, including 3 sub-rows 1002, 1004, and 1006, each coupled to a respective one of word sub-lines 904(*a–c*). As shown in FIG. 2, each pixel cell is serviced by a pair of data lines, but the data lines are not shown in FIG. 10, so as not to unnecessarily obscure the drawing. Driver circuit 900 loads a row of data into the pixel cells of row 1000, by sequentially asserting write signals on word sub-lines 904 (*a–c*), thus loading the row one sub-row at a time.

Figure 11:
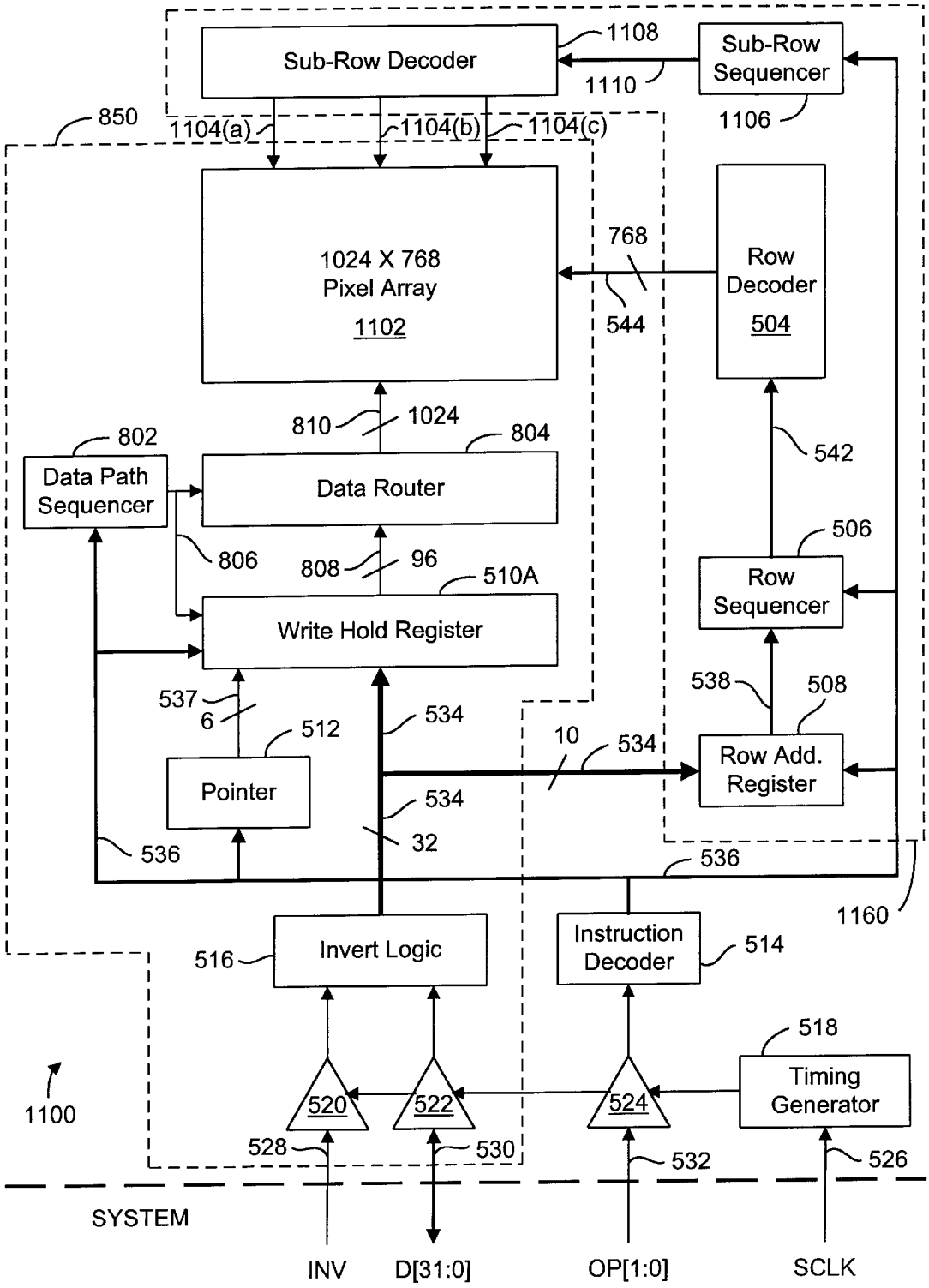
FIG. 11 is a block diagram of a fourth embodiment of a display driver circuit, in accordance with the present invention.

FIG. 11 shows another alternate display driver circuit 1100, in accordance with the present invention, for driving a display 1102. Display 1102 is similar to display 502 except that each row is divided into 3 sub-rows, each sub-row being serviced by one of word lines 544 and one of a set of word sub-lines 1104(*a–c*). Data is written to a particular sub-row when write signals are simultaneously asserted on the word line and the word sub-line associated with the particular sub-row, as will be explained below with reference to FIG. 12.

Display driver circuit 1100 is substantially similar to display driver circuit 800, except for the addition of sub-row sequencer 1106 and sub-row decoder 1108. Sub-row sequencer 1106 generates a series of sub-row addresses, and communicates the addresses, via a set of address lines 1110, to sub-row decoder 1108 which decodes each address and asserts a write signal on a corresponding one of word sub-lines 1104(*a–c*).

Row sequencer 506 and sub-row sequencer 1106 operate together to sequentially write data to the sub-rows of display 1102. Responsive to the system asserting an Array Write command (10) on op-code bus 532, instruction decoder 514 asserts control signals on control bus 536 causing row sequencer 506 to generate a series of select line addresses, as described above with respect to FIG. 5. The control signals asserted by instruction decoder 514 also cause sub-row sequencer 1106 to generate a series of sub-row addresses. The series of row addresses is synchronized with the series of sub-row addresses to write data to a row of pixel cells as follows. Row sequencer 506 asserts an initial row address on address lines 542, causing row decoder 504 to assert a write signal on an initial one of word lines 544. At the same time, sub-row sequencer 1106 asserts an initial sub-row address on address lines 1110, causing sub-row decoder 1108 to assert a write signal on word sub-line 1104(*a*). The two concurrent write signals cause the first sub-row of the initial row to be updated. Next, while the initial row address is still being asserted by row sequencer 506, sub-row sequencer 1106 sequentially asserts the next two sub-row addresses on address lines 1110, causing sub-row decoder 1108 to sequentially assert write signals on word sub-lines 1104(*b*) and 1104(*c*), sequentially writing data to the second and third sub-rows of the initial row. As row sequencer 506 asserts each successive row address of the series, sub-row sequencer reasserts the series of sub-row addresses, thus writing data to each row of display 11102, one sub-row at a time. Thus, sub-row decoder 1108, sub-row sequencer 1106, row decoder 504, row sequencer 506, and row address register 508 function together as sub-row selecting means 1160 for selecting a sub-row of display 1102 to which the data provided by data processing means 850 is to be written.

The series of row addresses is synchronized with the series of sub-row addresses at the SCLK level. In particular a common control signal initiates the assertion of the first address by both row sequencer 506 and sub-row sequencer 1106. After the assertion of the initial addresses, sub-row sequencer 1106 asserts the next address in the series of sub-row addresses every clock cycle, whereas row sequencer 506 asserts the next address in the series of row addresses only after receiving the next Array Write command. Similarly, the series of data path addresses generated by data path sequencer 802 is synchronized with the series of sub-row addresses, so that the appropriate data is routed to the appropriate sub-row, in coordination with the write signals.

Those skilled in the art will recognize that there are many other ways to synchronize the series of row addresses with the series of sub-row addresses. For example, in an alternate embodiment, sub-row sequencer 1106 and row sequencer 506 are replaced with a single sequencer that generates a 12 bit address, the 2 least significant bits being provided to sub-row decoder 1108 and the 10 most significant bits being provided to row decoder 504. Then, as the 12-bit address is incremented, each successive row is updated one sub-row at a time.

Figure 12:
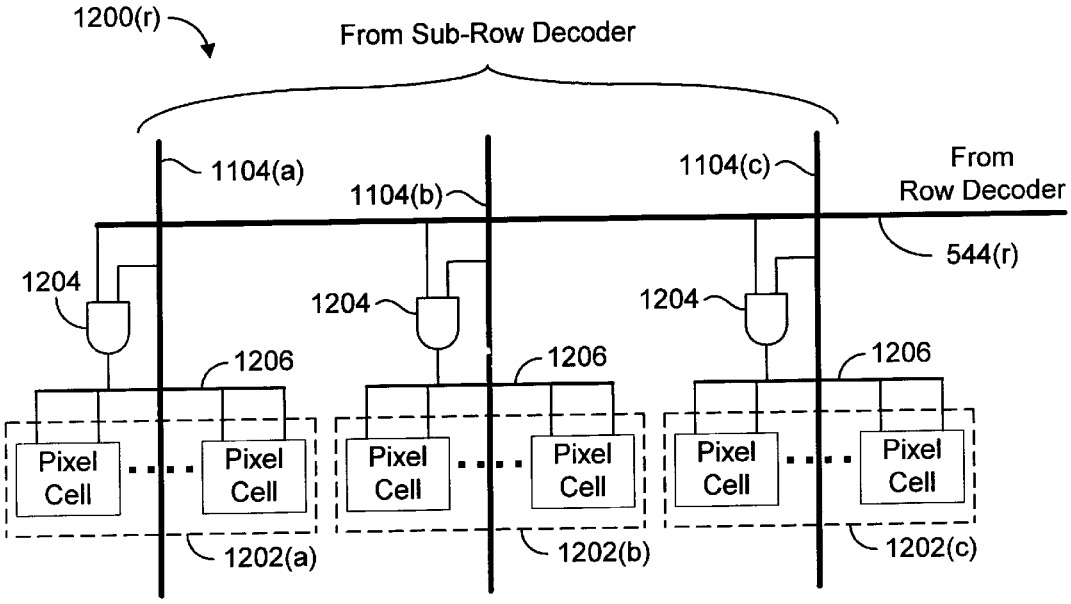
FIG. 12 is a block diagram of a row of pixel cells of the display driver circuit of FIG. 11.

FIG. 12 shows the organization of one row 1200(*r*) of pixel cells of display 1102. Row 1200(*r*) includes 3 sub-rows of pixel cells 1202(*a–c*), 3 AND gates 1204, and 3 local word lines 1206. Each AND gate 1204 has a first input terminal coupled to word line 544(*r*), a second input terminal coupled to an associated one of word sub-lines 1104 (*a–c*), and an output terminal coupled to an associated one of local word lines 1206. Responsive to a write signal being asserted on its first and second input terminals by word line 544(*r*) and associated word sub-line 1104, each AND gate 1204 asserts a write signal on associated local select line 1206.

Those skilled in the art will understand that rows of pixel cells may be divided into a greater or lesser number of sub-rows. In the limiting case, the number of sub-rows is equal to the number of pixels in each row, each pixel constituting a sub-row.

Figure 13:
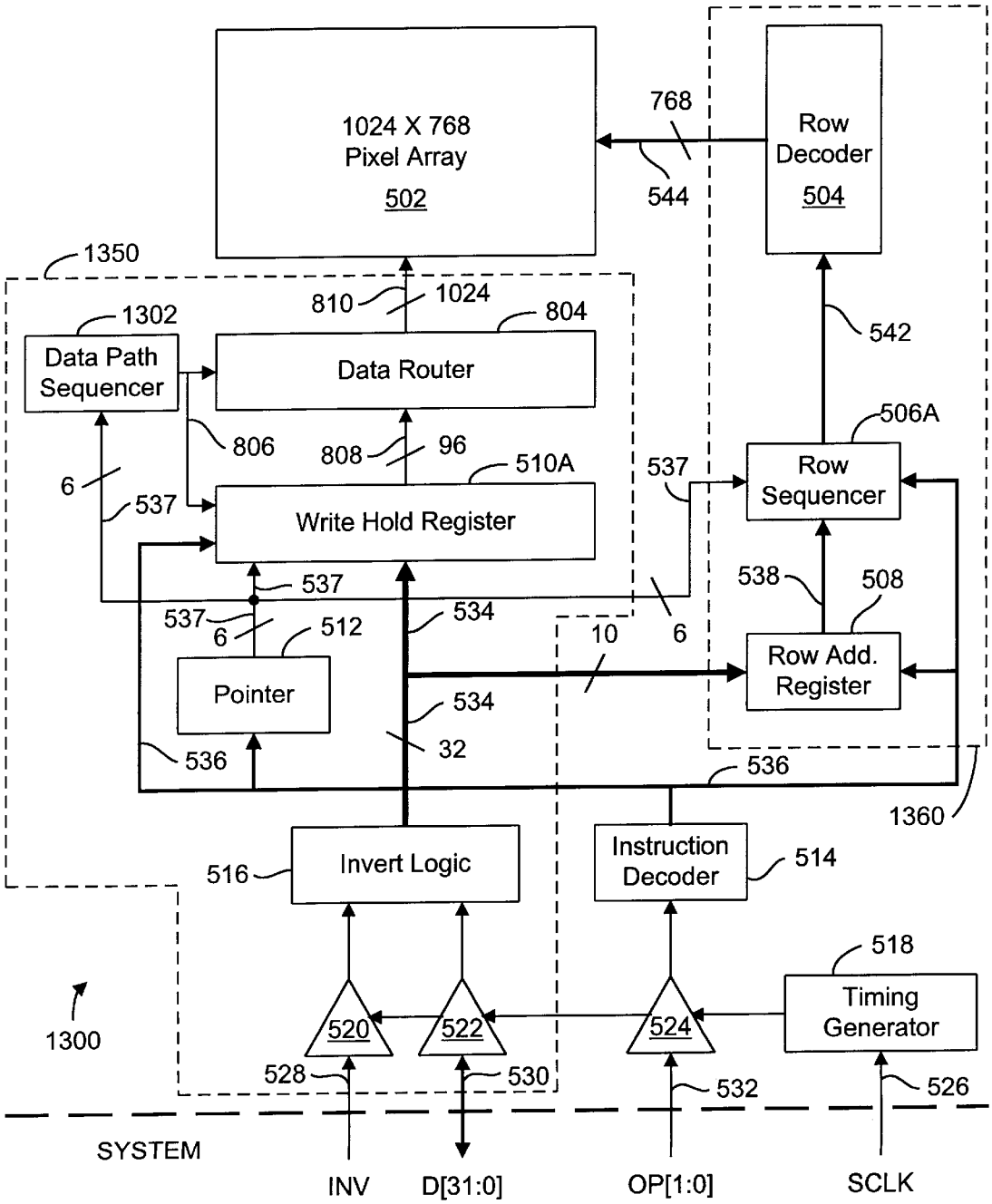
FIG. 13 is a block diagram of a fifth embodiment of a display driver circuit, in accordance with the present invention.

FIG. 13 shows another alternate display driver circuit 1300, in accordance with the present invention. Display driver circuit 1300 is similar to display driver circuit 800, except that data path sequencer 1302 of display driver circuit 1300 receives input, via lines 537, from pointer 512, instead of from instruction decoder 514, and, optionally, row sequencer 506A also receives input via lines 537, from pointer 512. Data path sequencer 1302 includes a counter which counts the changes in the address asserted on lines 537 by pointer 512, and updates the data path address asserted on address lines 806 accordingly. Row sequencer 506A is configured to count the data load control signals asserted on control bus 536 or, optionally, the changes in the address asserted on lines 537 by pointer 512, and increment the row address asserted on address lines 542 accordingly. In an alternate embodiment, data path sequencer 1302 includes a decoder, which decodes the address asserted on lines 537 by pointer 512, and updates the data path address asserted on address lines 806 accordingly. In either case, no Array Write commands are necessary to write data from write hold register 510A to display 502.

Those skilled in the art will recognize that write hold register 510A, pointer 512, data path sequencer 1302, data router 804, invert logic 516, and buffers 520 and 522 function together as data processing means 1350 for receiving data from the system, accumulating and formatting the data, and providing the data to display 502. Row decoder 504, row sequencer 506A, and row address register 508 function together as row selecting means 1360 for selecting a row of display 502 to which the data provided by data processing means 1350 is to be written. Instruction decoder 514 functions as instruction means for receiving op-code instructions from the system, and controlling and coordinating data processing means 1350 and row selecting means 1360 responsive to the received op-code instructions.

The description of particular embodiments of the present invention is now complete. Many of the described features may be substituted, altered or omitted without departing from the scope of the invention. For example, those skilled in the art will recognize that the embodiments described herein may be modified to drive displays having a greater or fewer number of rows (or sub-rows), by providing, a sequencer capable of generating an appropriate address series and a corresponding number of word lines (or sub-lines).

We claim:

1. A display driver circuit for receiving data and data load instructions from a system, and for driving a display having a plurality of data input lines and a first plurality of word lines, each word line being associated with a portion of said display, such that write signals asserted on said word lines cause data asserted on said data input lines to be loaded into said associated portions of said display, said display driver circuit comprising:

data processing means responsive to said data load instructions and operative upon receipt of each said data load instruction to receive a first predetermined quantity of data from said system, to accumulate said data, and to assert the accumulated data on said data input lines of said display when a second predetermined quantity of data is accumulated; and display portion selecting means for receiving said data load instructions and for generating write signals for causing data to be loaded into said associated portions of said display, said display portion selecting means being operative to assert a first write signal on a first one of said word lines causing data initially asserted on said data input lines to be loaded into an associated portion of said display, and to determine from said data load instructions when a third predetermined quantity of data has been subsequently asserted on said data input lines, and in response thereto, asserting a second write signal onto a second word line associated with a second portion of said display, said display portion selecting means thereafter continuing to determine each time a third predetermined quantity of data has been subsequently asserted on said data input lines, and in response thereto, asserting a subsequent write signal onto a subsequent word line associated with a subsequent portion of said display, until all incoming data has been received.

2. A display driver circuit according to claim 1, wherein said display portion selecting means comprises:

a row sequencer responsive to said data load instructions and operative to provide a series of row addresses, said row sequencer providing each subsequent row address responsive to receipt of a first predetermined number of said data load instructions; and a row decoder responsive to said series of row address and operative to assert a write signal on one of said first plurality of word lines corresponding to each of said row addresses.

3. A display driver circuit according to claim 2, wherein said display portion selecting means Further comprises a row address register, operative to provide an initial row address to said row sequencer.

4. A display driver circuit according to claim 3, wherein said row address register, responsive to a load row address instruction from said system, is further operative to receive another initial row address from said system and to provide said another initial row address to said row sequencer.

5. A display driver circuit according to claim 4, wherein said row sequencer, responsive to said load row address instruction and said another initial row address, is operative to provide a new series of row addresses starting from said another initial row address.

6. A display driver circuit according to claim 2, wherein said display further includes a second plurality of word lines, each of which is associated with a portion of said display, such that the simultaneous assertion of write signals on one of said first plurality of word lines and on one of said second plurality of word lines causes data asserted on said data input lines to be loaded into a particular portion of said display, and wherein said display portion selecting means further comprises:

a sub-row sequencer responsive to said data load instructions and operative to provide a series of sub-row addresses, said sub-row sequencer providing each subsequent sub-row address responsive to receipt of a second predetermined number of said data load instructions; and a sub-row decoder responsive to said series of sub-row addresses and operative to assert a write signal on one of said second plurality of word lines corresponding to each of said sub-row addresses.

7. A display driver circuit according to claim 1, wherein said display portion selecting means comprises:

a sub-row sequencer responsive to said data load instructions and operative to provide a series of sub-row addresses, said sub-row sequencer providing each subsequent sub-row address responsive to receipt of a predetermined number of said data load instructions; and a sub-row decoder responsive to said series of sub-row address and operative to assert a write signal on one of said first plurality of word lines corresponding to each of said sub-row addresses.

8. A display driver circuit according to claim 1, wherein said data processing means asserts the accumulated data on said data input lines responsive to receipt of a first predetermined number of said data load instructions.

9. A display driver circuit according to claim 8, wherein said data processing means comprises:

a pointer responsive to said data load instructions and operative to provide a series of register portion addresses, said pointer providing each subsequent register portion address responsive to receipt of one of said data load instructions;

a data path sequencer responsive to said data load instructions and operative to provide a series of path addresses, said data path sequencer providing each subsequent path address responsive to receipt of said first predetermined number of said data load instructions;

a register responsive to said series of register portion addresses and said data load instructions and operative to receive said data from said system and store said data in portions of said register corresponding to said register portion addresses, said register being further responsive to said data path addresses and operative to provide accumulated data from groups of said register portions corresponding to said data path addresses.

10. A display driver circuit according to claim 9, further comprising a data router responsive to said series of data path addresses and operative to receive said accumulated data from said groups of said register portions and assert said accumulated data on groups of said data lines corresponding to said data path addresses.

11. A display driver circuit according to claim 9, wherein said data path sequencer comprises a counter for counting said data load instructions.

12. A display driver circuit according to claim 11, wherein said counter comprises a divide-by-n counter.

13. A display driver circuit according to claim 8, wherein said data processing means comprises:

a pointer responsive to said data load instructions and operative to provide a series of register portion addresses, said pointer providing each subsequent register portion address responsive to receipt of one of said data load instructions;

a data path sequencer responsive to said series of register portion addresses and operative to provide a series of path addresses, said data path sequencer providing each subsequent path address responsive to receipt of a first predetermined number of said register portion addresses;

a register responsive to said series of register portion addresses and said data load instructions and operative to receive said data from said system and store said data in portions of said register corresponding to said register portion addresses, said register being further responsive to said data path addresses and operative to provide accumulated data from groups of said register portions corresponding to said data path addresses.

14. A display driver circuit according to claim 13, wherein said data path sequencer comprises a counter for counting said register portion addresses.

15. A display driver circuit according to claim 14, wherein said counter comprises a divide-by-n counter.

16. A display driver circuit according to claim 13, wherein said data path sequencer comprises a decoder, for decoding said register portion addresses to generate said data path addresses.

17. A display driver circuit according to claim 13, wherein said display portion selecting means comprises:

a row sequencer responsive to said series of register portion addresses and operative to provide a series of row addresses, said row sequencer providing each subsequent row address responsive to receipt of a second predetermined number of said register portion addresses; and a row decoder responsive to said series of row address and operative to assert a write signal on one of said first plurality of word lines corresponding to each of said row addresses.

18. A display driver circuit according to claim 1, wherein after asserting a write signal on a last one of said word lines and responsive to determining that said third predetermined quantity of data has been subsequently asserted on said data input lines, said display portion selecting means asserts another write signal on said first one of said word lines.

19. A display driver circuit according to claim 18, wherein said first one of said word lines corresponds to a top portion of said display and said last one of said word lines corresponds to a bottom portion of said display.

20. In a display driver circuit for receiving data words and data load instructions from a system, and for driving a display having a plurality of data input lines and a first plurality of word lines, each word line being associated with a portion of said display such that write signals asserted on said word lines cause data asserted on said data input lines to be loaded into said associated portions of said display, a method for driving said display comprising the steps of:

asserting a first write signal on one of said word lines;

receiving data load instructions from said system;

receiving a first predetermined quantity of data from said system responsive to each said data load instruction;

accumulating said data;

asserting the accumulated data on said data input lines each time a second predetermined quantity of data is accumulated;

determining from said data load instructions when a third predetermined quantity of data has been subsequently asserted on said data input lines; and asserting a subsequent write signal on a subsequent word line associated with a subsequent portion of said display, each time said third predetermined quantity of data has been subsequently asserted on said data input lines.

21. A method for driving a display according to claim 20, wherein said step of asserting a subsequent write signal on a subsequent word line associated with a subsequent portion of said display, each time said third predetermined quantity of data has been subsequently asserted on said data input lines comprises the steps of:

generating a series of row addresses, each row address being generated responsive to receipt of a first predetermined number of said data load instructions;

decoding each row address; and asserting a write signal on one of said first plurality of word lines corresponding to each decoded row address.

22. A method for driving a display according to claim 21, wherein said step of generating a series of row addresses comprises the steps of:

receiving a first initial row address; and generating a series of row addresses based on said first initial row address.

23. A method according to claim 22, wherein said step of generating a series of row addresses further comprises the steps of:

receiving another initial row address; and generating another series of row addresses based on said another initial row address.

24. A method according to claim 21, wherein said display further includes a second plurality of word lines, each of which is associated with a portion of said display, such that the simultaneous assertion of write signals on one of said first plurality of word lines and on one of said second plurality of word lines causes data asserted on said data input lines to be loaded into a particular portion of said display, said method further comprising the steps of:

generating a series of sub-row addresses, each sub-row address being generated responsive to receipt of a second predetermined number of said data load instructions;

decoding each sub-row address; and asserting a write signal on one of said second plurality of word lines corresponding to each decoded sub-row address.

25. A method according to claim 20, wherein said step of asserting a subsequent write signal on a subsequent word line associated with a subsequent portion of said display, each time said third predetermined quantity of data has been subsequently asserted on said data input lines comprises the steps of:

generating a series of sub-row addresses, each sub-row address being generated responsive to receipt of a predetermined number of said data load instructions;

decoding each sub-row address; and asserting a write signal on one of said first plurality of word lines corresponding to each decoded sub-row address.

26. A method according to claim 20, wherein said step of asserting the accumulated data on said data input lines each time a second predetermined quantity of data is accumulated comprises the steps of:

determining when a predetermined number of data load instructions have been received; and asserting the accumulated data on said data input lines each time said predetermined number of data load instructions are received.

27. A method according to claim 26, wherein said step of accumulating said data comprises the steps of:

generating a series of register portion addresses, each subsequent register portion address being generated in response to receipt of one of said data load instructions; and storing each first predetermined quantity of data in a portion of a register corresponding to one of said register portion addresses.

28. A method according to claim 27, wherein said step of asserting the accumulated data on said data input lines each time a second predetermined quantity of data is accumulated comprises the steps of:

generating a series of data path addresses, each subsequent data path address being generated in response to receipt of a first predetermined number of said data load instructions; and providing the accumulated data from groups of said register portions corresponding to said data path addresses.

29. A method according to claim 27, wherein said step of asserting the accumulated data on said data input lines each time a second predetermined quantity of data is accumulated further comprises the step of asserting said accumulated data on groups of said data lines corresponding to said data path addresses.

30. A method according to claim 27, wherein said step of asserting the accumulated data on said data input lines each time a second predetermined quantity of data is accumulated comprises the steps of:

generating a series of data path addresses, each subsequent data path address being generated in response to receipt of a first predetermined number of said register portion addresses; and providing the accumulated data from groups of said register portions corresponding to said data path addresses.

31. A method for driving a display according to claim 30, wherein said step of asserting a subsequent write signal on a subsequent word line associated with a subsequent portion of said display, each time said third predetermined quantity of data has been subsequently asserted on said data input lines comprises the steps of:

generating a series of row addresses, each row address being generated responsive to receipt of a second predetermined number of said register portion addresses;

decoding each row address; and asserting a write signal on one of said first plurality of word lines corresponding to each decoded row address.

* * * * *